US006254153B1

(12) United States Patent
Poppa

(10) Patent No.: US 6,254,153 B1
(45) Date of Patent: Jul. 3, 2001

(54) CLEANING TOOL

(76) Inventor: Virgil V. Poppa, 8244 Greenwood Ave., Munster, IN (US) 46321

( * ) Notice: Subject to any disclaimer, the term of this patent is extended or adjusted under 35 U.S.C. 154(b) by 0 days.

(21) Appl. No.: 09/454,462

(22) Filed: Dec. 3, 1999

Related U.S. Application Data

(63) Continuation of application No. 09/046,038, filed on Mar. 23, 1998, now Pat. No. 6,017,070.

(51) Int. Cl.[7] ..... E04D 13/076
(52) U.S. Cl. ..... 294/19.1; 294/103.1; 15/236.04
(58) Field of Search ..... 294/11, 19.1, 22, 294/34, 103.1, 119.1; 15/236.04; 56/337

(56) References Cited

U.S. PATENT DOCUMENTS

| | | | | |
|---|---|---|---|---|
| 747,376 | * | 12/1903 | Christman | 294/2 |
| 2,720,409 | * | 10/1955 | Griffith | 294/19.1 |
| 2,817,867 | * | 12/1957 | Bugbird | 294/19.1 |
| 2,896,239 | * | 7/1959 | Bugbird | 294/19.1 |
| 3,601,835 | * | 8/1971 | Morgan | 15/105 |
| 3,743,339 | * | 7/1973 | Brackett | 294/19.1 |
| 3,858,267 | * | 1/1975 | Swannie | 294/19.1 |
| 3,972,552 | * | 8/1976 | Earp, Jr. | 294/19.1 |
| 4,057,276 | * | 11/1977 | Currie | 294/19.1 |
| 4,114,938 | * | 9/1978 | Strader | 294/19.1 |
| 4,194,780 | * | 3/1980 | Dilley | 294/19.1 |
| 4,310,940 | * | 1/1982 | Moore | 15/105 |
| 4,319,851 | * | 3/1982 | Arthur | 401/137 |
| 4,640,540 | * | 2/1987 | Chisholm | 294/55 |
| 4,653,142 | * | 3/1987 | Upton | 294/19.1 |
| 4,750,883 | * | 6/1988 | Drake | 401/137 |
| 4,848,818 | * | 7/1989 | Smith | 294/19.1 |
| 4,930,824 | * | 6/1990 | Matthews et al. | 294/19.1 |
| 4,958,397 | * | 9/1990 | Ryan | 15/93.1 |
| 5,114,199 | * | 5/1992 | Newcomer | 294/50.8 |
| 5,192,014 | * | 3/1993 | Lin | 294/19.1 |
| 5,618,075 | * | 4/1997 | Baziuk | 294/19.1 |
| 5,626,377 | * | 5/1997 | Carroll, Jr. et al. | 294/19.1 |
| 5,727,580 | * | 3/1998 | Patterson | 134/115 R |
| 5,823,590 | * | 10/1998 | Forrest et al. | 294/19.1 |
| 5,853,209 | * | 12/1998 | McDermott | 294/19.1 |

* cited by examiner

*Primary Examiner*—Dean J. Kramer
(74) *Attorney, Agent, or Firm*—Baniak Pine & Gannon

(57) ABSTRACT

A cleaning tool is particularly adapted for cleaning gutters from a position below the gutter, such as on the ground. The tool has members which are movable relative to each other by a mechanism that is manipulated by the user on a pole that allows the members to be placed at an elevated site and then closed upon the material to be removed, then lifted and the material released.

3 Claims, 3 Drawing Sheets

FIG. 1
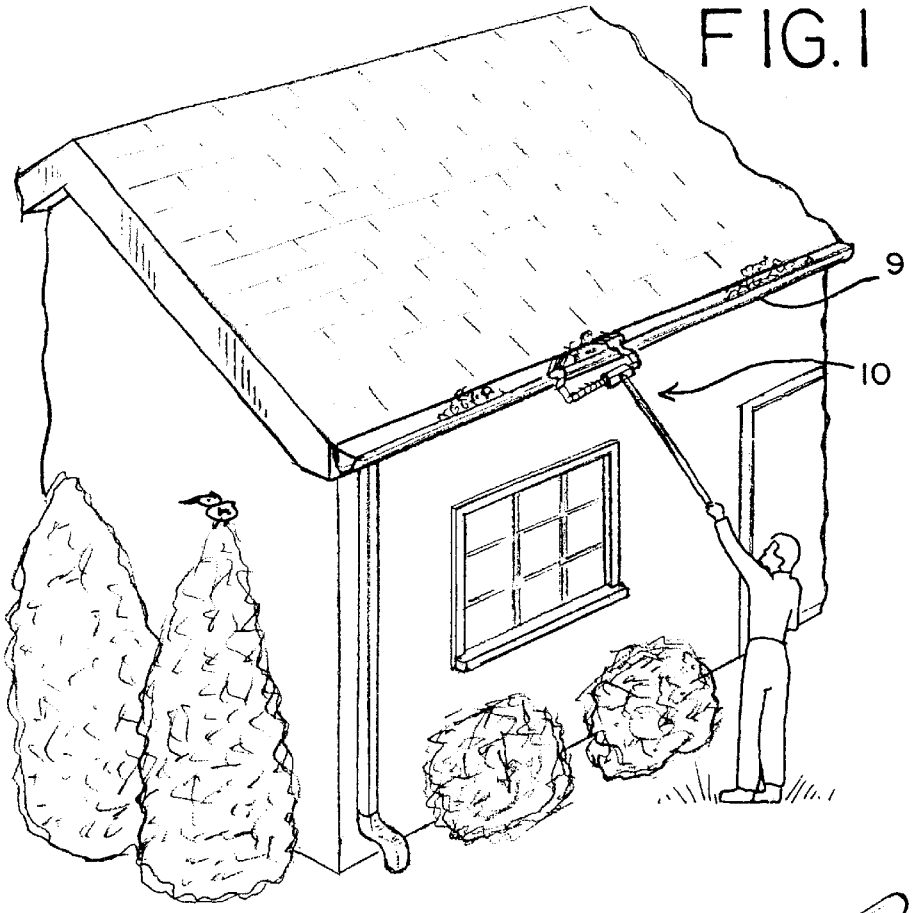
FIG. 2
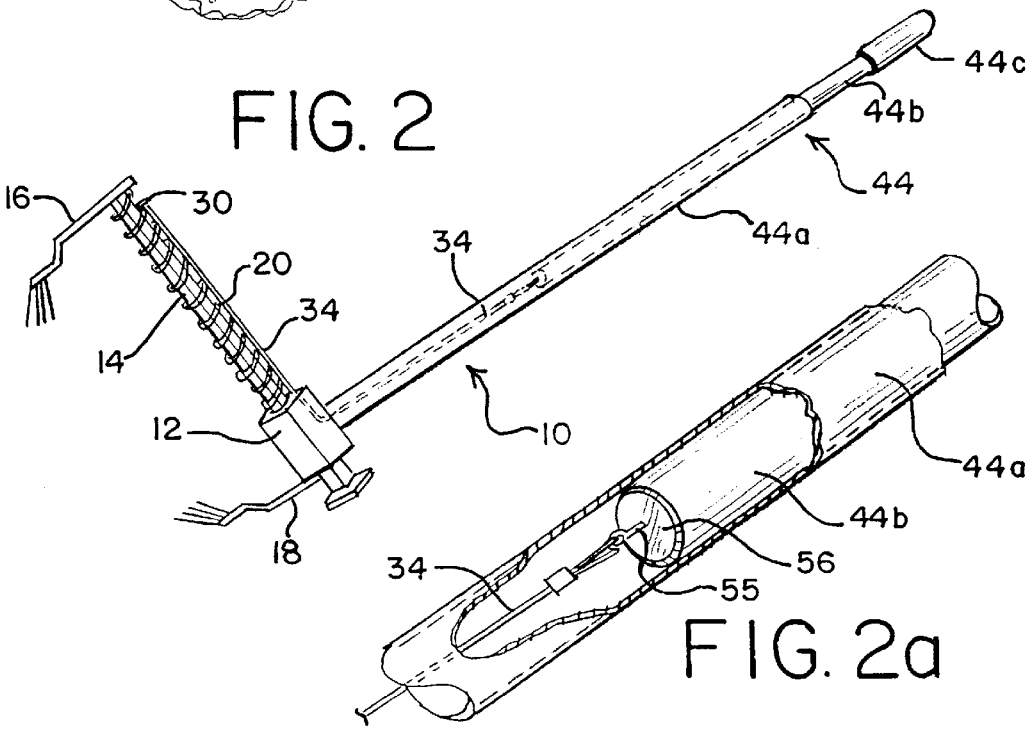
FIG. 2a

CLEANING TOOL

This is a continuation of prior application Ser. No. 09/046,038 filed Mar. 23, 1998, now U.S. Pat. No. 6,017,070.

BACKGROUND OF THE INVENTION

The present invention relates to cleaning tools, and in particular to gutter cleaning devices.

Gutters are used on buildings to direct the flow of rainwater from the roof. The use of gutters prevents rainwater from falling uncontrolled to the ground. Gutters tend to become clogged with debris such as leaves, pine needles, twigs, roofing material and other things. An accumulation of this debris makes it difficult for water to flow through the gutter and may result in permanent damming and overflow.

Over time many tools have been developed which have been used to facilitate the cleaning of gutters. Common tools require the user to either clean the gutter from the roof itself or climb up a ladder to reach the gutter. Many of these tools require the user to reach into the gutter with a short hand tool, which can be an unpleasant experience on a hot day. While there have been many gutter cleaning tools developed, it can easily be seen that there is still a need for a gutter cleaning device which does not have the aforementioned drawbacks.

SUMMARY OF THE INVENTION

A unique cleaning device has been invented which overcomes many of the deficiencies noted above, particularly since it is handy and manually operable from a distance, as for instance from the ground for use on an elevated point. The present invention, while having general application as a tool for grasping and moving material, has found particular application as a gutter cleaning device. In such an embodiment, the invention comprises a pole having a near end and a far end. An implement, or tool tip, adapted to be received within a gutter channel is carried on an implement mount extending from the pole. A mechanism is provided which is operable to move the implement relative to a press member, with which the implement interacts to grasp material in the gutter between the press member and the implement when the mechanism is operated to move the implement toward the press member.

In a presently preferred embodiment, the implement mount includes a base or head fixed adjacent the far end of the pole, and an elongated slidable member movably mounted on the head. The implement is fixedly mounted on the elongated member, and moves with it under action of the moving mechanism. The press member is fixedly mounted to the head.

A line, such as a cable, cord, rope, wire or the like, extends along the pole, such as inside the pole, from the near or ground end to the head. The line turns at a pivot on the head to a first attachment point on the mount. A pulling force on the line away from the near end causes the mount, and the implement carried thereon, to move relative to the head.

A first channel is formed in the head within which the elongated member is received for movement therein. A second channel formed in the head receives the line therein. The second channel includes the pivot in the form of a bend defining a shoulder about which the line snakes.

The pole is preferably extensible, and comprises a first pole part within which a second pole part is received for movement into and out of the first pole part. The line is connected to the second pole part at a second attachment point. In the foregoing embodiment, a resilient member biases the implement away from the press member.

Thus, when the second pole part is moved out of the first pole part, the line is drawn with it pulling the implement toward the press member against the bias of the resilient member, to grasp material therebetween. The resilient member moves the implement away from the press member when the second pole part is moved into the first pole part, which releases the grasped material.

In this embodiment, the implement and press member most preferably take the form of rakes that extend generally perpendicularly from the elongated member in the case of the implement, and from the head in the case of the press member. The rakes are mountable in a plurality of positions forming a plurality of angles relative to an axis defined by the pole, which accommodates placing the rakes into the gutter from differing positions on the ground. A guide for positioning the tool on the gutter edge is also advantageously provided.

A releasable locking element which fixes the first and second pole parts together is also advantageously provided. An eccentric carried on the second pole part which engages the first pole part and frictionally locks the two parts in place when the second pole part is rotated can be used.

The invention will be further understood upon consideration of the following detailed description of an embodiment taken in conjunction with the drawings, which are:

BRIEF DESCRIPTION OF THE DRAWINGS FOR A PREFERRED EMBODIMENT OF THE INVENTION

FIG. 1 is a perspective view of a person using a gutter cleaning device with an embodiment of the invention;

FIG. 2 is a perspective view of a gutter cleaning device made in accordance with the invention;

Figure 3:
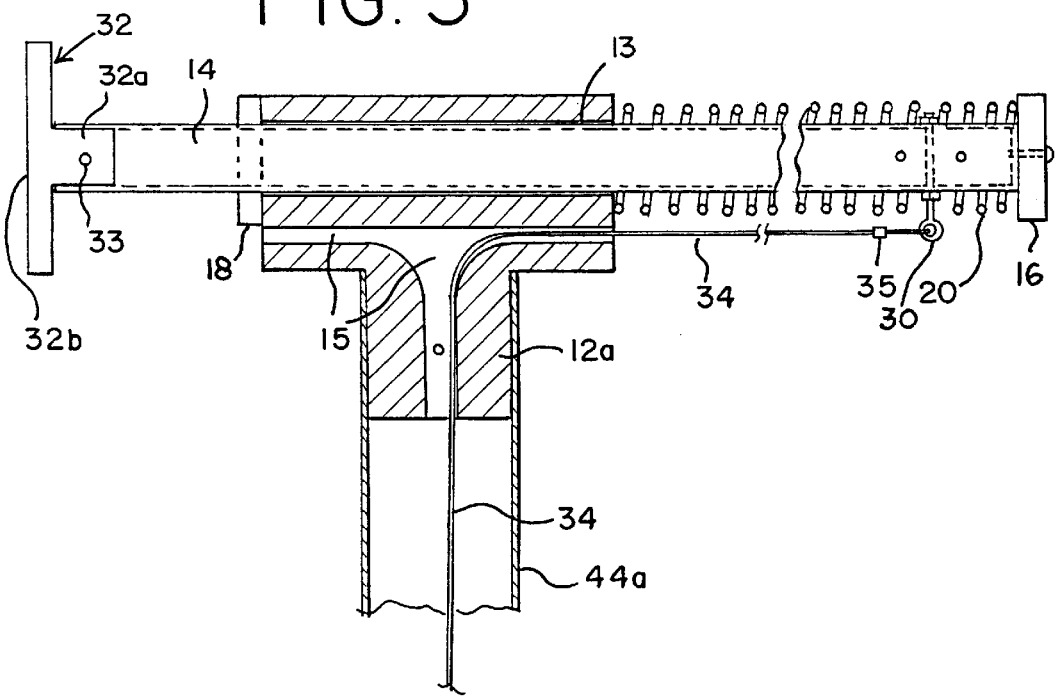
Figure 4:
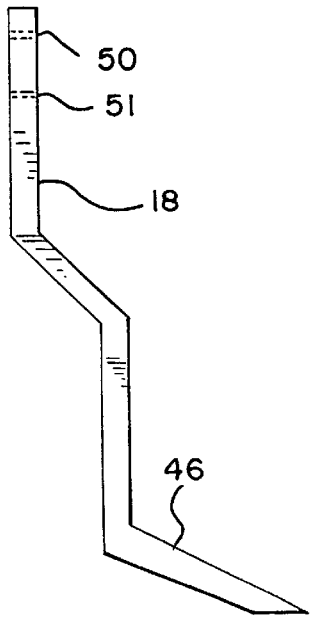
Figure 5:
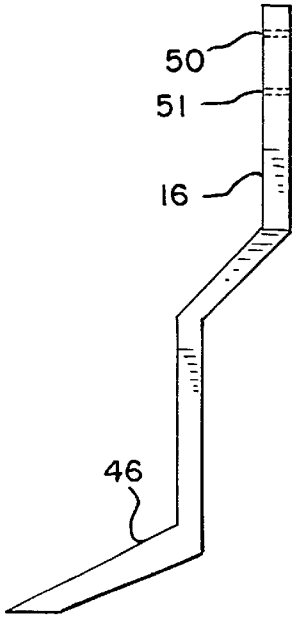
Figure 6:
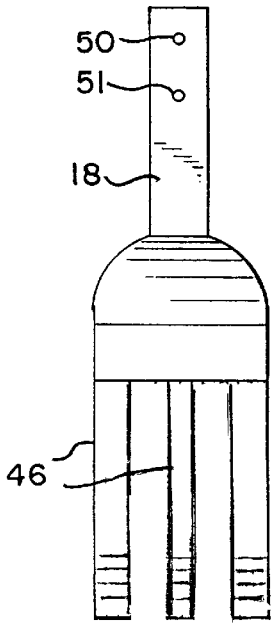
Figure 7:
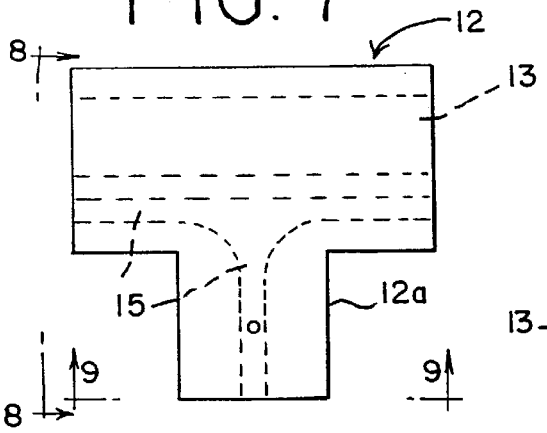
Figure 8:
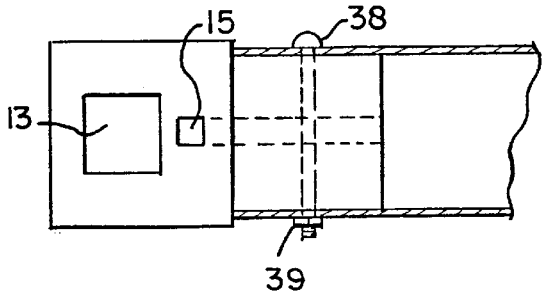
Figure 9:
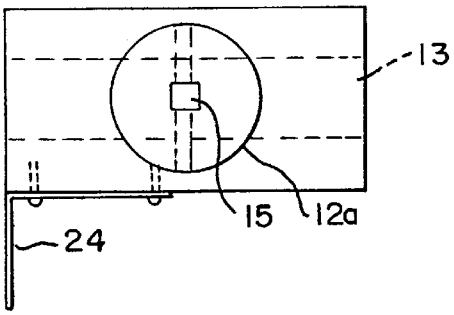
Figure 10:
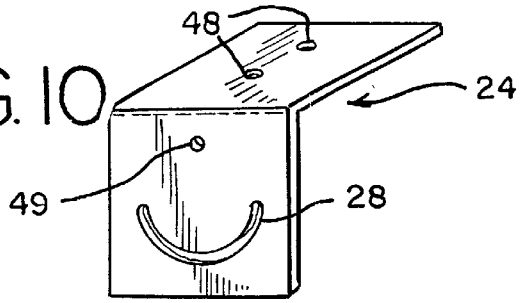
Figure 12:
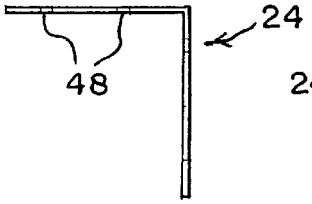
Figure 11:
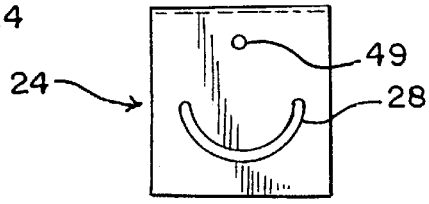

FIG. 2*a* is a cutaway view of the end of one pole part which is within the other pole part;

FIG. 3 is a cross-sectional view of the head of the gutter cleaning device of FIG. 2;

FIG. 4 is a side view of one of the rakes used with the gutter cleaning device of FIG. 2;

FIG. 5 is a side view of the other rake used with the gutter cleaning device of FIG. 2;

FIG. 6 is a front elevational view of the rake;

FIG. 7 is a cross-sectional view of the head of the gutter cleaning device similar to that of FIG. 2, but with the line and mount removed for clarity;

FIG. 8 is a side view taken along line 8—8 of FIG. 7;

FIG. 9 is an end view taken along line 9—9 of FIG. 8;

FIG. 10 is a perspective view of a mounting bracket;

FIG. 11 is a front elevational view of the bracket of FIG. 10;

FIG. 12 is a side elevational view of the bracket of FIG. 11; and

Figure 13:
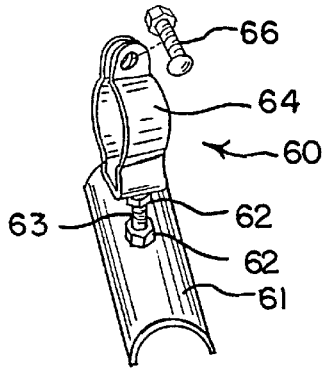

FIG. 13 is a perspective view of a gutter guide.

DETAILED DESCRIPTION OF THE DRAWINGS AND AN EMBODIMENT OF THE INVENTION

The invention has presently taken the form of a gutter cleaning device 10, as shown in FIGS. 1–13. It should be borne in mind, however, that it may be readily adaptable to other applications where remote grasping of material is desired.

As seen in the perspective view of FIG. 1, the tool 10 is primarily designed to remove debris from gutters 9. The gutter cleaning device 10 includes a head or base 12 attached to an end of an extensible pole member 44.

A slidable member or implement mount 14 slides within a passageway or channel 13 (e.g., FIGS. 7–9) of the head 12 and is biased away from the head 12 using a spring 20. An implement or tool tip 16 is fixed to an end of the slidable mount, and a like tool tip or press member 18 is fixed to the head 12.

The head 12 preferably contains another channel 15. A cable 34 (e.g., FIGS. 2 and 3) is disposed throughout the length of the pole member 44 and through the channel 15 in the head 12, and fixed to the slidable member 14.

As best seen in FIGS. 3 and 7–9, the head 12 is T-shaped, and is made of metal such as aluminum, rigid plastic, or the like. The neck portion 12*a* of the head 12 is circular in cross section and sized to fit within the end of the pole, and is fixed to the pole using a stove bolt 38 and nut 39 combination. It will be noted that the pole 44 is formed of a first pole part 44*a* within which a second pole part 44*b* is received. The head provides a means for securing the slidable member and press member or tool tip 18 to the extensible pole member 44.

More particularly, and as shown in FIG. 8, cut or formed within the head 12 is the passageway 13 which is sized and shaped to accommodate the slidable member 14. In addition, FIGS. 3 and 8 show the generally rectangular T-shaped channel 15 that is partially cut or formed within the head 12. The channel 15 is shaped to accommodate the cable 34 and provides a means to guide the cable through the pole 44 and head 12.

As shown in FIG. 3, the slidable implement mount 14 is disposed in the passageway 13, and is rectangular in shape and is sized so that it may move freely within the passageway 13. The mount 14 is preferably made of metal such as aluminum stock. The mount 14 is movable between a first position and a second position. In the first position, shown in FIG. 4, the implement or tool tip 16 on mount 14 is extended away from the head 12. In a second position, the tool tip 16 is retracted through sliding of the mount 14 in the head 12, such that the tool tip is then located adjacent to the head 12, whereby material in the gutter is grasped between the tool tip 16 and the tool tip or press member 18.

The slidable mount member 14 cooperates with the spring 20 to provide a means to bias the tool tip 16 outwardly relative to the head 12. The spring 20 is disposed around the slidable member 14 and acts to bias the tool tip 16 to the first position, extended away from the head 12. As shown in FIG. 3, a pin 30 is fixed in the slidable member 14. The pin 30 has a circular loop on an end to which the cable 34 is attached, as by looping therethrough with attachment back on itself using crimp or clamp 35.

A push pad 32 is attached to the slidable member 14 outward of the fixed tool tip 18. The push pad 32 is T-shaped, with a neck portion 32*a* that is sized and shaped to fit inside the end of the slidable member 14, and is held in place by screw or bolt 33. The pad 32 itself has a square head 32*b*, which is useful to push material in the gutter to dislodge it for pick-up, for example.

As best shown in FIG. 3, the tool tip 16 is fixed to an end of the slidable member 14. As shown in FIGS. 5 and 6, the tool tip 16, as well as the tool tip 18, are preferably claw or rake shaped and contains several rigid fingers or prongs 46. In this embodiment, tool tips 16 and 18 are made of rigid plastic.

Tool tip 16 is secured to the slidable member 14 using an L-shaped metal bracket 24. As shown in FIGS. 10–12, this bracket 24 contains screw holes 48 for attachment of one half of the L of the bracket to the mount 14, as with screws. A crescent-shaped groove 28 is cut into the other half of the L of the bracket, with an additional bolt hole 49. A bolt and nut combination (not shown) is used to connect the tool tip 16 to the bracket 24 at hole 49 via throughbore 50 formed in the tool tip (FIG. 5). The tool tip 16 is further attached through a like bolt and nut combination, such as a wing nut, at groove 28 via throughbore 51. The groove 28 allows the tool tip 16 to rotate in a semicircular path defined by the range of the groove.

As shown in FIG. 9, tool tip 18 is fixed to the underside of the head 12 using another L-shaped bracket 24. The tool tip 18 is preferably the same shape as the right tool tip 16, and is mounted to its bracket in the same manner as tool tip 16.

The pole member 44 is, as noted above, comprised of two sections or parts 44*a* and 44*b*. The parts 44*a*, 44*b* are preferably cylindrical in shape and made of aluminum tube, and can be of the type of extensible pole used with pool cleaning tools. The second part 44*b* of the pole member is sized so that it slides within the first part 44*a*. Further, a locking mechanism, shown in FIG. 2*a*, is provided within the pole member that fixes it in position. The locking mechanism is of the eccentric type 56 commonly used with such extensible poles for pool cleaning tools, for example, and well known. Also, a handle grip 44*c* (FIG. 1) is provided on the end of the second pole part 44*b*, to allow the user to more easily grip and manipulate the pole.

As perhaps best seen in FIGS. 2, 2*a* and 3, the cable 34 is located within the pole 44 and is connected to the end of pole part 44*b*, as at an eyelet 55 attached to the eccentric 56, with the cable 34 looped therethrough and tied, crimped or clamped back on itself. The cable 34 runs through the channel 15 and is connected to the pin 30 at its other end.

A gutter guide 60 (FIG. 13) can also be provided. The guide 60, which is used to balance and orient the tool on the gutter 9, has an elongated shoe 61 within which the rim edge of the gutter is received. The shoe 61 is mounted on a bolt 63 which is fixed via back up nuts 62 to clamp 64. Clamp 64 is a stand-off strap having two legs, which are held together by a nut and bolt combination 66. This gives the guide adjustability, since it is slidably mounted on the pole part 44*a*.

In use, the pole 44 is raised by the user and the tool tips 16, 18 are placed in the gutter 9 so that the prongs 46 rest against the base of the gutter. Next, the second part 44*b* of the pole is pulled outwardly from the first pole part 44*a*. The cable 34 is pulled through the channel 15, thereby causing the slidable member 14 to move towards the head 12. The tool tip 16 moves along with the slidable mount 14 towards the head 12 and pulls material, such as leaves, along the gutter.

The leaves become sandwiched between the tool tips 16, 18. Pole part 44*b* is then rotated, causing the eccentric 56 to lock against the interior sidewall of the first pole part 44*a*, fixing the pole parts in position. The pole 44 is then lowered, the pole part 44*b* is rotated again but in an opposite direction to now release the lock, and the pole part 44*b* is then pushed into the other pole part 44*a*. Tool tip 16 is biased away from the head 12 by the spring 20 and the leaves are released.

It should be appreciated that the present invention is capable of being incorporated in the form of a variety of embodiments, only one of which has been illustrated and described above. The invention may be embodied in other forms without departing from its spirit or essential characteristics. The described embodiment is to be considered in all respects only as illustrative and not restrictive, and the scope of the invention is, therefore, indicated by the appended claims rather than by the foregoing description. All changes which come within the meaning and range of equivalency of the claims are to be embraced within their scope.

What is claimed is:

1. A tool for clearing material comprising:

an elongated pole having a near end and a far end;

a first and a second implement;

an implement mount carrying said implements, said implement mount located on said pole adjacent said far end;

a mechanism operable to move at least said first implement toward said second implement comprising a line extending along said pole from said near end to a first attachment point, whereby a pulling force on said line away from said near end causes said first implement to move relatively toward said second implement;

said pole being extensible and comprising a first pole part which telescopes with a second pole part for movement, said line being fixedly connected to said second pole part at a second attachment point, said tool further including a resilient member biasing said implements apart, said second pole part when moved outboard relative to said first pole part drawing said line with it and pulling said first implement toward said second implement against the bias of said resilient member from a first extended position to a second grasping position, said resilient member moving said implements away from each other to said first extended position when said second pole part is moved inboard relative to said first pole part, and a releasable locking mechanism engaging said first and second pole parts together through rotation of one pole part relative to the other pole part.

2. The tool of claim 1 wherein said locking mechanism is an eccentric carried on said second pole part which engages said first pole part and frictionally locks said parts in place when said second pole part is rotated about said axis.

3. A gutter cleaning device comprising:

(a) an extensible pole member having a first pole part within which a second pole part is received;

(b) a base attached to an end of said first pole part;

(c) a mount extending from said base;

(d) a first tool tip attached to an end of said mount;

(e) a second tool tip attached to another end of said mount;

(f) a spring biasing said tool tips apart;

(g) a cable within said pole member attached at one end to at least said first tool tip for pulling said tool tip from a first extended position to a second grasping position, and attached to said second pole part at another cable end, such that said cable pulls said first tool tip toward said second tool tip when said second pole member is pulled outwardly from said first pole member to capture material in the gutter between said tool tips in said grasping position.

* * * * *